US008991987B2

(12) United States Patent
Kobashi et al.

(10) Patent No.: US 8,991,987 B2
(45) Date of Patent: Mar. 31, 2015

(54) FLUID EJECTING APPARATUS AND CLEANING METHOD

(71) Applicant: Seiko Epson Corporation, Shinjuku-ku, Tokyo (JP)

(72) Inventors: Masaru Kobashi, Matsumoto (JP); Yoichi Yamada, Shiojiri (JP); Daisuke Matsumoto, Matsumoto (JP); Tomohiro Aruga, Matsumoto (JP); Kiyoteru Katsuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/033,116

(22) Filed: Sep. 20, 2013

(65) Prior Publication Data

US 2014/0022315 A1 Jan. 23, 2014

Related U.S. Application Data

(62) Division of application No. 13/020,751, filed on Feb. 3, 2011, now abandoned.

(30) Foreign Application Priority Data

Feb. 5, 2010 (JP) ..... 2010-024815
Feb. 5, 2010 (JP) ..... 2010-024816

(51) Int. Cl.
*B41J 2/17* (2006.01)
*B41J 2/175* (2006.01)
*B41J 2/165* (2006.01)

(52) U.S. Cl.
CPC ..... *B41J 2/17596* (2013.01); *B41J 2/16532* (2013.01); *B41J 2/16585* (2013.01)
USPC ..... 347/85; 347/84

(58) Field of Classification Search
CPC ..... B41J 2/07; B41J 2/045; B41J 2/055; B41J 2/017; B41J 2/175; B41J 2/17596; B41J 2/17556; B41J 2/17523; B41J 2202/12
See application file for complete search history.

(56) References Cited

U.S. PATENT DOCUMENTS

| | | | | |
|---|---|---|---|---|
| 6,948,803 | B2 | 9/2005 | Yoshida et al. | |
| 2006/0268050 | A1 | 11/2006 | Sonobe | |
| 2007/0126816 | A1 | 6/2007 | Nishida | |
| 2008/0079768 | A1 * | 4/2008 | Kachi | 347/20 |
| 2008/0158307 | A1 | 7/2008 | Nitta et al. | |
| 2008/0273064 | A1 * | 11/2008 | Ota et al. | 347/85 |
| 2008/0297545 | A1 | 12/2008 | Umeda | |

FOREIGN PATENT DOCUMENTS

| | | | |
|---|---|---|---|
| JP | 2005-271584 | A | 10/2005 |
| JP | 2006-224435 | A | 8/2006 |
| JP | 2007-152725 | A | 6/2007 |
| JP | 2009-113421 | A | 5/2009 |
| JP | 2009-148928 | A | 7/2009 |

* cited by examiner

*Primary Examiner* — Stephen Meier
*Assistant Examiner* — Renee I Wilson
(74) *Attorney, Agent, or Firm* — Kilpatrick Townsend & Stockton LLP

(57) ABSTRACT

A printer includes: a fluid ejecting head provided with multiple nozzles that eject ink; an ink supply tube that supplies the ink to the fluid ejecting head; and a pressure application mechanism that pressurizes the ink to swell from the nozzles by pressurizing the ink within the ink supply tube and then depressurizes the interior of the ink supply tube while the ink is swelling from the nozzles.

5 Claims, 13 Drawing Sheets

FIG. 9

| REGION | LENGTH (mm) | INTERNAL VOLUME (cc) |
|---|---|---|
| NO. 1 INK CARTRIDGE 26 | — | 50 |
| NO. 2 INK SUPPLY TUBE 27 (INNER DIAMETER 3 mm) (UPSTREAM FROM PRESSURE CHAMBER 75) | 500 | 3.5 |
| NO. 3 PRESSURE CHAMBER 75 | — | 1.0 |
| NO. 4 INK SUPPLY TUBE 27 (INNER DIAMETER 3 mm) (DOWNSTREAM FROM PRESSURE CHAMBER 75) | 270 | 1.9 |
| NO. 5 COMMON INK CHAMBER 30 | — | 3.1 |
| NO. 6 LIQUID EJECTING HEAD 24×8 | — | 0.9 |

FIG. 10A

| PRESSURIZED INK AMOUNT Vd (cc) | GOOD/POOR |
|---|---|
| 0.22 > Vd | × |
| 0.22 ≤ Vd ≤ 0.62 | ○ |
| 0.62 < Vd | × |

○: GOOD × : POOR

FIG. 10B

| | | PRESSURIZING TIME Ta (s) | | |
|---|---|---|---|---|
| | | 0.05 > Ta | 0.05 ≤ Ta ≤ 0.5 | 0.5 < Ta |
| DEPRESSURIZING TIME Td (s) | 0.09 > Td | × | × | × |
| | 0.09 ≤ Td ≤ 0.7 | × | ○ | × |
| | 0.7 < Td | × | × | × |

(0.22 ≤ Vd ≤ 0.62, Ta < Td)

○: GOOD × : POOR

FIG. 13A

| PRESSURIZED INK AMOUNT Vd (cc) | GOOD/POOR |
|---|---|
| 0.18 > Vd | × |
| 0.18 ≤ Vd ≤ 0.48 | ○ |
| 0.48 < Vd | × |

○ : GOOD × : POOR

FIG. 13B

| | | PRESSURIZING TIME Ta (s) | | |
|---|---|---|---|---|
| | | 0.025 > Ta | 0.025 ≤ Ta ≤ 0.2 | 0.2 < Ta |
| DEPRESSURIZING TIME Td (s) | 0.1 > Td | × | × | × |
| | 0.1 ≤ Td ≤ 0.5 | × | ○ | × |
| | 0.5 < Td | × | × | × |

(0.18 ≤ Vd ≤ 0.48, Ta < Td)

○ : GOOD × : POOR

FLUID EJECTING APPARATUS AND CLEANING METHOD

This application is a divisional of U.S. patent application Ser. No. 13/020,751, filed Feb. 3, 2011, which claims the priority of Japanese Patent Application Nos. 2010-024815, filed Feb. 5, 2010 and 2010-024816, filed Feb. 5, 2010, the entire disclosures of which are incorporated by reference herein.

BACKGROUND

1. Technical Field

The present invention relates to fluid ejecting apparatuses and cleaning methods for such fluid ejecting apparatuses.

2. Related Art

Ink jet printers have been widely known for some time as fluid ejecting apparatuses that eject a fluid onto a medium. Such printers carry out processes for printing onto a medium by ejecting ink (a fluid) from nozzles formed in a fluid ejecting head.

In such printers, there have been occurrences of missing dots in printed images, which are caused by attempting to eject ink in a state in which bubbles have entered into a nozzle and the nozzle thus experiences blank ejections. There are printers that execute a cleaning process in which ink is discharged along with the bubbles within the nozzle in order to suppress the occurrence of printing problems caused by missing dots (for example, see JP-A-2007-152725).

Such a cleaning process consumes a large amount of ink in order to discharge the bubbles, and thus in JP-A-2007-152725, the amount of ink supplied is changed depending on the severity of the printing problem. Nevertheless, a significant amount of ink is still consumed by this cleaning process, and thus the further reduction of the amount of ink consumed is still an issue.

SUMMARY

An advantage of some aspects of the invention is to provide a fluid ejecting apparatus and a cleaning method capable of discharging bubbles while suppressing the consumption of fluid.

A fluid ejecting apparatus according to an aspect of the invention includes: a fluid ejecting head provided with multiple nozzles that eject a fluid; a fluid supply channel that supplies the fluid to the fluid ejecting head; and a pressure application mechanism that causes the fluid to swell from the nozzles by pressurizing the fluid within the fluid supply channel, and then depressurizes the interior of the fluid supply channel while the fluid is swelling from the nozzles.

According to this configuration, some of the fluid is caused to swell from the nozzles by the pressure application mechanism pressurizing the fluid within the fluid supply channel, making it possible to push bubbles that have intermixed with the fluid at the swollen area out to the atmospheric side, which is outside of the nozzle openings. The pressure application mechanism depressurizes the interior of the fluid supply channel immediately after the pressurization, which then pulls the fluid that has swollen from the nozzles due to the pressurization back into the fluid ejecting head, so that the fluid is not wastefully consumed by falling from the nozzle openings or the like. Accordingly, the bubbles can be discharged while suppressing the consumption of fluid.

In the fluid ejecting apparatus according to another aspect of the invention, a depressurizing time for which the pressure application mechanism carries out the depressurization is longer than a pressurizing time for which the pressure application mechanism carries out the pressurization.

According to this configuration, by pressurizing for a short amount of time so as to ensure the bubble discharge properties while also making the depressurizing time longer than the pressurizing time, it is possible to suppress bubbles from being sucked in through the nozzle openings.

In the fluid ejecting apparatus according to another aspect of the invention, the pressure application mechanism carries out the pressurization by causing the volume of the fluid supply channel to decrease, and carries out the depressurization by causing the volume of the fluid supply channel to increase.

According to this configuration, by the pressure application mechanism reducing the volume of the fluid supply channel, an amount of fluid equivalent to the reduced volume is pushed out, thus making it possible to transmit the pressure toward the nozzles side. Because depressurization is carried out by increasing the volume of the fluid supply channel, the depressurization can be carried out immediately after the pressurization by returning the volume, which has been reduced for pressurization, to its original state.

In the fluid ejecting apparatus according to another aspect of the invention, the volume of the fluid supply channel caused to increase by the pressure application mechanism for the depressurization is less than the volume of the fluid supply channel caused to decrease by the pressure application mechanism for the pressurization.

According to this configuration, when bubbles are discharged from the nozzles through pressurization, an equivalent air gap is produced within the nozzles; however, the volume of the fluid supply channel increased for depressurization is lower than the volume of the fluid supply channel reduced for pressurization, making it possible to suppress the occurrence of empty nozzles caused by the air gaps.

In a fluid ejecting apparatus according to another aspect of the invention, multiple fluid ejecting heads are provided, and the apparatus further includes a fluid holding chamber that holds the fluid supplied via the fluid supply channel and supplies the held fluid to the multiple fluid ejecting heads.

According to this configuration, the meniscuses of the nozzles can be unified by adjusting the backpressure of the nozzles in the fluid holding chamber. The pressure application mechanism is provided upstream from the fluid holding chamber in the fluid flow channel, and thus increasing the number of fluid ejecting heads does not complicate the configuration.

In the fluid ejecting apparatus according to another aspect of the invention, the pressurizing time for which the pressure application mechanism carries out the pressurization is between 0.025 seconds and 0.5 seconds.

According to this configuration, the pressurizing time for which the pressure application mechanism carries out pressurization is between 0.025 and 0.5 seconds, and is thus extremely short; accordingly, it is possible to dislodge bubbles that have adhered to the inner walls of the nozzles and discharge those bubbles.

A cleaning method according to another aspect of the invention is a cleaning method for a fluid ejecting apparatus, the apparatus including a fluid ejecting head provided with multiple nozzles that eject a fluid and a fluid supply channel that supplies the fluid to the fluid ejecting head, and the method including: pressurizing the fluid to swell from the nozzles by pressurizing the fluid within the fluid supply channel; and after the pressurization, depressurizing the interior of the fluid supply channel while the fluid is swelling from the nozzles.

According to this configuration, the same effects as those of the aforementioned fluid ejecting apparatus can be achieved.

A fluid ejecting apparatus according to another aspect of the invention includes: a fluid ejecting head provided with multiple nozzles that eject a fluid; a fluid supply channel that supplies the fluid to the fluid ejecting head; an on-off valve provided in the fluid supply channel; and a pressure application mechanism that pressurizes the fluid to swell from the nozzles by pressurizing the fluid within the fluid supply channel downstream from the closed on-off valve.

According to this configuration, some of the fluid is pressurized to swell from the nozzles by the pressure application mechanism pressurizing the fluid within the fluid supply channel, making it possible to push bubbles that have intermixed with the fluid at the swollen area out to the atmospheric side, which is outside of the nozzle openings. Because the on-off valve is closed at this time, fluid is not supplied to nozzles from the fluid supply channel that is upstream therefrom. Accordingly, bubbles can be discharged from the nozzles while suppressing the consumption of fluid.

In the fluid ejecting apparatus according to another aspect of the invention, the pressure application mechanism depressurizes the interior of the fluid supply channel in a state in which the on-off valve is closed and the fluid is swelling from the nozzles due to the pressurization.

According to this configuration, because the pressure application mechanism depressurizes the interior of the fluid supply channel after pressurization while maintaining the closed state of the on-off valve, fluid that is swelling from the nozzles can be pulled back into the fluid ejecting head without being consumed wastefully due to dripping down from the nozzle openings and so on. Accordingly, the meniscuses of the nozzles can be suppressed from breaking, and the consumption of fluid can be suppressed as well. The pressure can be increased by the amount of fluid that is pulled back due to the depressurization, thus making it possible to improve the bubble discharge properties.

In a fluid ejecting apparatus according to another aspect of the invention, multiple fluid supply channels are provided and the same number of pressure application mechanisms as the fluid supply channels is provided.

According to this configuration, multiple pressure application mechanisms are provided in accordance with the number of fluid supply channels that are installed, thus making it possible to discharge bubbles for each of the fluid supply channels.

A cleaning method according to another aspect of the invention is a cleaning method for a fluid ejecting apparatus, the apparatus including a fluid ejecting head provided with multiple nozzles that eject a fluid, a fluid supply channel that supplies the fluid to the fluid ejecting head, and an on-off valve provided in the fluid supply channel, and the method including: closing the on-off valve; and after closing the on-off valve, pressurizing the fluid to swell from the nozzles by pressurizing the fluid within the fluid supply channel downstream from the on-off valve.

According to this configuration, the same effects as those of the aforementioned fluid ejecting apparatus can be achieved.

BRIEF DESCRIPTION OF THE DRAWINGS

The invention will be described with reference to the accompanying drawings, wherein like numbers reference like elements.

FIG. 6A illustrates a state prior to pressurization and FIG. 6B illustrates a state during pressurization.

FIG. 7A illustrates a state prior to pressurization, FIG. 7B illustrates a state during pressurization, FIG. 7C illustrates a state during depressurization, and FIG. 7D illustrates a state when the apparatus is at rest.

FIG. 9 is a chart illustrating a flow channel condition 1 in an ink jet printer according to the first embodiment.

FIG. 10A is a chart illustrating a pressurized ink amount range under the flow channel condition 1, and FIG. 10B is a chart illustrating pressurizing time and depressurizing time ranges under the flow channel condition 1.

FIG. 12A illustrates a closed state and FIG. 12B illustrates an open state.

FIG. 13A is a chart illustrating a pressurized ink amount range under a flow channel condition 2 in an ink jet printer according to the second embodiment, and FIG. 13B is a chart illustrating pressurizing time and depressurizing time ranges under the flow channel condition 2.

DESCRIPTION OF EXEMPLARY EMBODIMENTS

First Embodiment

Figure 1:
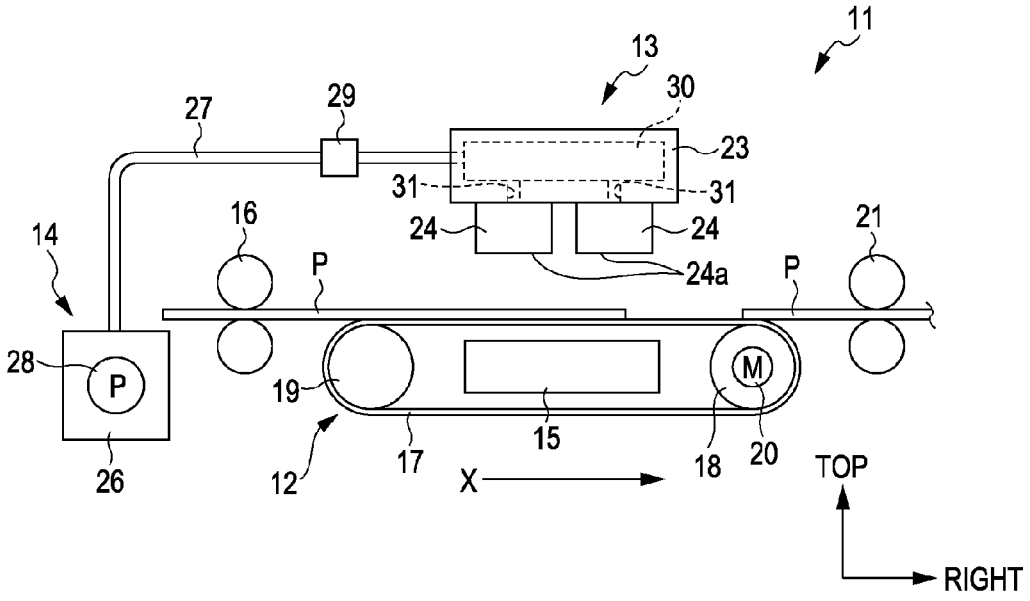
FIG. 1 is a schematic front view illustrating the overall configuration of an ink jet printer according to a first embodiment.

Hereinafter, a first embodiment, in which the invention is embodied as an ink jet printer (called simply a "printer" hereinafter) serving as a type of fluid ejecting apparatus, will be described with reference to FIGS. 1 through 10. Note that the terms "depth direction", "horizontal direction", and "vertical direction" as used in the descriptions hereinafter refer respectively to the depth direction, horizontal direction, and vertical direction indicated by the arrows in the drawings.

As shown in FIG. 1, a printer 11 includes a transport unit 12 that transports paper P serving as a medium, a line head 13 that executes a printing process on the paper P, an ink supply unit 14 that supplies ink serving as a fluid to the line head 13, and a maintenance unit 15.

The transport unit 12 includes a pair of paper feed rollers 16, an endless transport belt 17, a driving roller 18, a slave roller 19, a driving motor 20 connected to the driving roller 18, and a pair of discharge rollers 21. The transport belt 17 is wrapped upon the driving roller 18 and the slave roller 19, and moves cyclically when the driving roller 18 rotates in the clockwise direction in FIG. 1 due to the driving of the driving motor 20. The paper feed rollers 16, transport belt 17, and discharge rollers 21 transport the paper P along a transport direction X. Multiple transport belts 17 (for example, two) are provided so as to support at least both ends of the paper P in a width direction Y (the depth direction), and the maintenance unit 15 is disposed between the transport belts 17 that are arranged in the depth direction.

Figure 2:
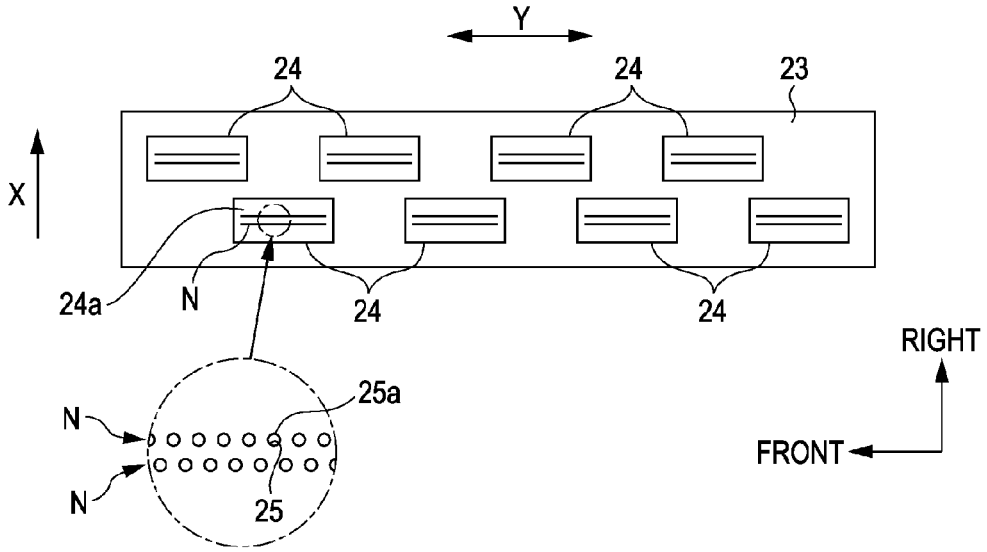
FIG. 2 is a bottom view illustrating the configuration of a line head.

The line head 13 includes a base unit 23 and fluid ejecting heads 24 supported by the base unit 23. As shown in FIG. 2, the fluid ejecting heads 24 are arranged in a staggered pattern so as to form two rows of lines that extend along the width direction Y of the paper P. The first row, located upstream in the transport direction X (that is, on the left side), is configured of four fluid ejecting heads 24 arranged along the width direction Y, whereas the second row, located downstream in the transport direction X (that is, on the right side), is configured of four fluid ejecting heads 24 arranged along the width direction Y.

Each fluid ejecting head 24 is provided with multiple nozzles 25 for ejecting ink. Two nozzle rows N that extend along the width direction Y are formed in a nozzle formation surface 24*a*, located on the bottom surface (base surface) of the fluid ejecting head 24, by nozzle openings 25*a* of the multiple nozzles 25. As shown in the enlarged area of FIG. 2, the nozzle openings 25*a* are disposed in a staggered manner so that the intervals at which the two nozzle rows N are disposed along the width direction Y are shifted by ½ pixel. The first and second rows of fluid ejecting heads 24 are arranged so that, when projected in the transport direction X, at least one nozzle 25 at the respective ends of the rows overlap, or so that the nozzles 25 at the respective ends of the rows are continuous with a space equivalent to the nozzle pitch provided therebetween.

Accordingly, the printer 11 is capable of printing across the maximum paper width range even with the line head 13 remaining in a fixed state. In this embodiment, a single fluid ejecting head 24 corresponds to 1.1 inches of paper, and thus eight fluid ejecting heads 24 cover the horizontal width of A4 (297 mm×210 mm) paper (that is, approximately 8.3 inches). A single nozzle row N is configured of 330 nozzles 25. Accordingly, a single line head 13 has 8 (the number of fluid ejecting heads 24 in the width direction Y)×2 (the number of nozzle rows N)×330 (the number of nozzles 25 of which each nozzle row N is configured), or 5,280 nozzles 25.

In the case where four-color printing using, for example, cyan (C), magenta (M), yellow (Y), and black (K) is to be carried out, one pair of the line heads 13 and the ink supply unit 14 is provided for each of the colors (however, for the sake of simplicity, FIGS. 1 and 2 show only one of each). A printing process can be carried out at a resolution of 600 dpi by superimposing ink droplets of the four colors from the four line heads 13 onto the transported paper P.

As shown in FIG. 1, the ink supply unit 14 includes an ink cartridge 26 that holds ink, an ink supply tube 27 that configures a fluid supply channel for supplying the ink from the ink cartridge 26 to the fluid ejecting head 24, and a pressure pump 28 that pressure-transfers the ink. The ink cartridge 26 is mounted in a cartridge holder (not shown) in a removable state and is connected to the ink supply tube 27. A pressure application mechanism 29 is provided partway along the ink supply tube 27.

A common ink chamber 30, which temporarily holds the ink supplied from the ink cartridge 26 via the ink supply tube 27, is provided in the base unit 23 of the line head 13. Multiple branch channels 31, corresponding to respective fluid ejecting heads 24, are connected to the common ink chamber 30. The ink held within the common ink chamber 30 is supplied to multiple fluid ejecting heads 24 via the branch channels 31.

Figure 3:
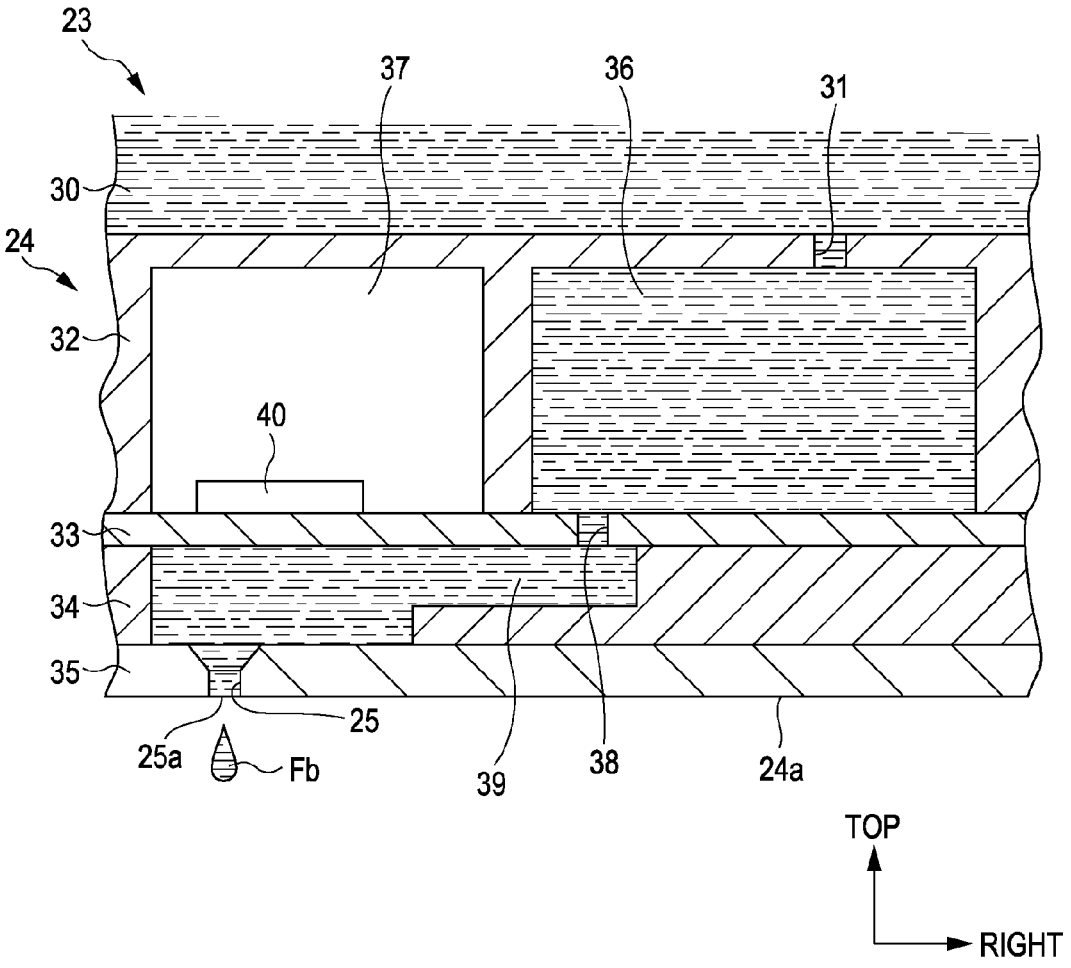
FIG. 3 is a cross-sectional view illustrating the overall configuration of the interior of a fluid ejecting head.

As shown in FIG. 3, each fluid ejecting head 24 includes a flow channel formation member 32, a vibrating plate 33, a flow channel formation member 34, and a nozzle plate 35, all stacked in the vertical direction. The branch channel 31 that communicates with the common ink chamber 30, a reservoir 36, and a holding chamber 37 are formed in the flow channel formation member 32. A communication hole 38 is provided in the vibrating plate 33 in a location that corresponds with the reservoir 36. A cavity 39 that communicates with the reservoir 36 via the communication hole 38 is formed in the flow channel formation member 34.

A piezoelectric element 40 is provided on the upper surface side of the vibrating plate 33 in a location that is above the cavity 39. The nozzle 25, which communicates with the cavity 39, is formed in the nozzle plate 35. In other words, the ink distributed to the fluid ejecting heads 24 from the common ink chamber 30 through the branch channels 31 is held in the reservoir 36, and is then supplied to the nozzles 25 from the reservoir 36 via the communication hole 38 and the cavity 39.

The vibrating plate 33 is provided so as to be capable of vibrating vertically. The vibrating plate 33 is caused to vibrate vertically by the piezoelectric element 40 extending/shrinking due to the application of a driving signal thereto. When the vibrating plate 33 vibrates vertically, the volume of the cavity 39 expands/shrinks. When the volume of the cavity 39 shrinks, the ink within the cavity 39 is ejected from the nozzle 25 as an ink droplet Fb. The nozzle formation surface 24*a* of the fluid ejecting head 24 is configured of the bottom surface (base surface) of the nozzle plate 35. In this embodiment, the diameter of each nozzle opening 25*a* is approximately 20 micrometers, and the thickness of the nozzle plate 35 in the vertical direction is approximately 100 micrometers.

Here, the ink cartridge 26 is provided in a position that is lower than the line head 13. Accordingly, the region within the fluid ejecting head 24 (the ink flow channel) has a negative pressure of approximately −1 kPa due to head differential. This negative pressure is for suppressing the ink from dripping down from the nozzle 25 and for stabilizing ejection operations by forming a concave-shaped meniscus within the nozzle 25.

Next, the maintenance unit 15 will be described.

Figure 4:
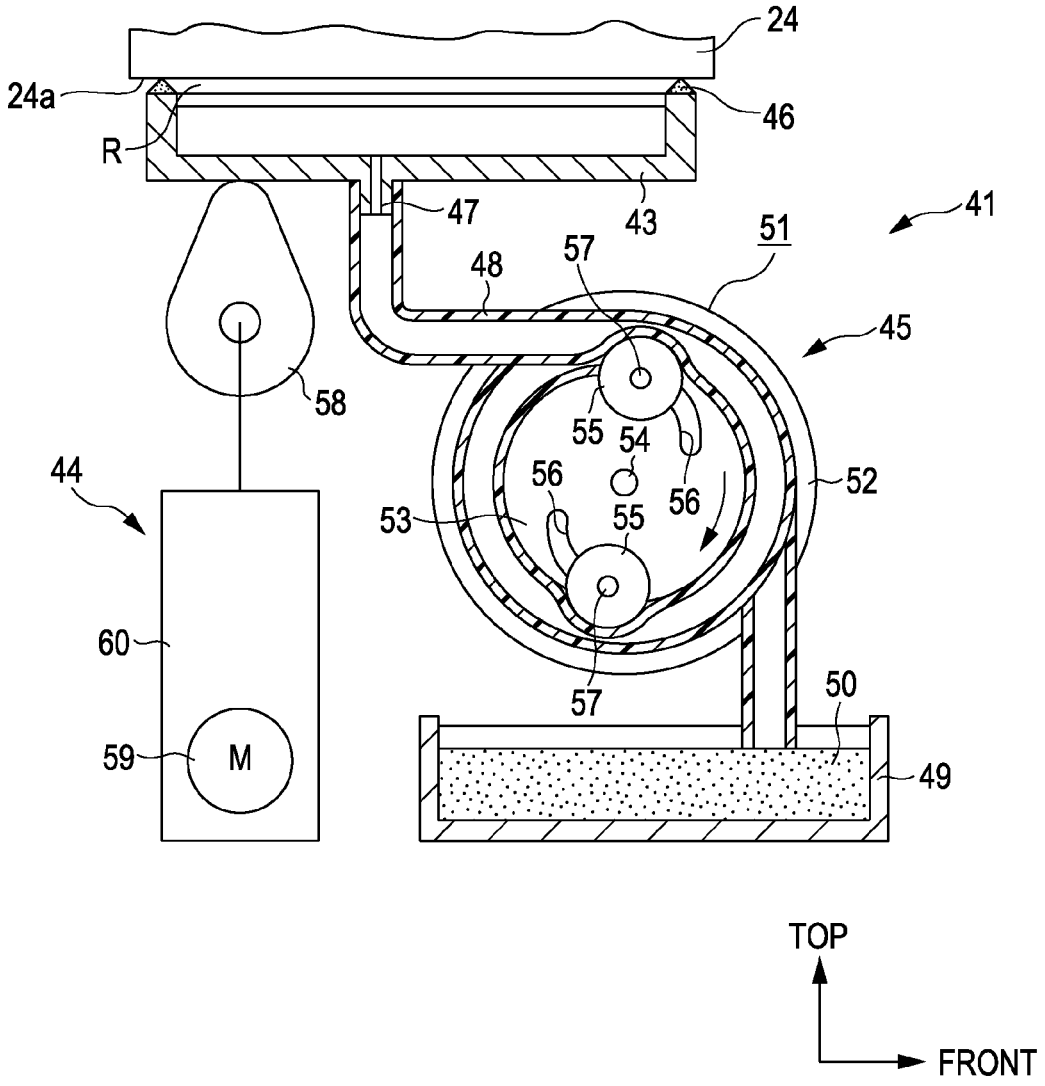
FIG. 4 is a cross-sectional view illustrating the overall configuration of a capping mechanism.
Figure 5:
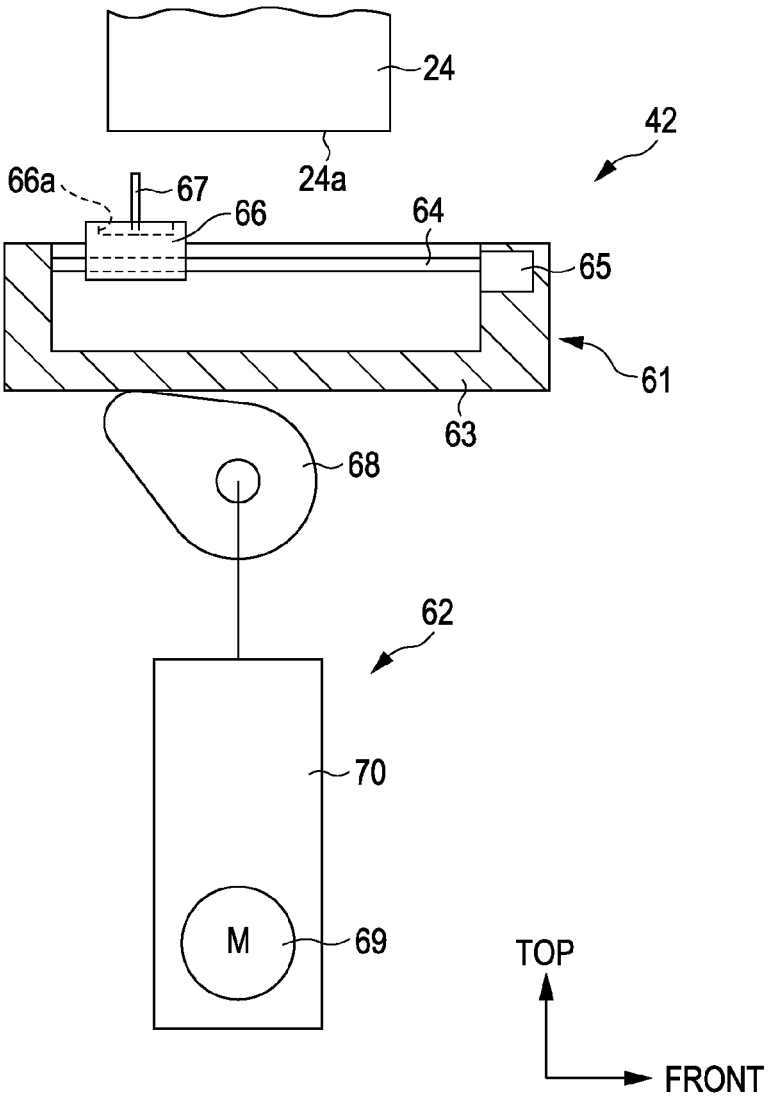
FIG. 5 is a cross-sectional view illustrating the overall configuration of a wiping unit.

The maintenance unit 15 includes a capping unit 41 for capping the nozzle formation surface 24*a* of the fluid ejecting head 24 (see FIG. 4) and a wiping unit 42 for wiping the nozzle formation surface 24*a* (see FIG. 5). The capping unit 41 and wiping unit 42 may be provided for each fluid ejecting head 24, or the multiple fluid ejecting heads 24 may be capped and wiped at the same time.

In addition to being used for capping that prevents the nozzles 25 from drying, the capping unit 41 is used when executing suction cleaning, in which ink within the ink cartridge 26 is sucked from the nozzles 25, thus discharging bubbles, thickened ink, and so on from the nozzles 25. Furthermore, the capping unit 41 is also used for catching ink discharged from the nozzles 25 during pressure cleaning, in which ink within the ink cartridge 26 is discharged from the nozzles 25 by the pressure pump 28. Meanwhile, the wiping unit 42 is used when wiping the nozzle formation surface 24*a* in order to remove objects stuck thereto, such as paper dust, ink, or the like, and when executing wiping for unifying the meniscuses of the nozzles 25.

First, the capping unit 41 will be described.

As shown in FIG. 4, the capping unit 41 includes a closed-end square box-shaped cap 43, a raising/lowering mechanism 44 that raises/lowers the cap 43, and a suction mechanism 45. A square frame-shaped sealing member 46, configured of a flexible material, is provided on the entirety of the top surfaces of the circumferential walls of the cap 43, whereas a discharge pipe 47 is provided protruding downward from the base wall of the cap 43.

One end of a discharge tube 48, which is composed of a flexible material and partially configures the suction mechanism 45, is connected to the discharge pipe 47. The other end of the discharge tube 48 is inserted into a waste ink tank 49. The waste ink tank 49 contains a waste ink absorption member 50 that is composed of a porous member.

A tube pump 51 of which the suction mechanism 45 is partially configured is disposed between the cap 43 and the waste ink tank 49. The tube pump 51 includes a cylindrical case 52, a pump wheel 53 that is circular when viewed from above, a wheel shaft 54, and a pair of pressure rollers 55. The pump wheel 53 is housed within the case 52 so as to be capable of rotation central to the wheel shaft 54, which in turn is provided central to the axis of the case 52. The middle portion of the discharge tube 48 is housed within the case 52 so as to follow the inner circumference of the walls of the case 52.

A pair of roller guidance grooves 56 having arc shapes are formed in the pump wheel 53 so as to oppose each other with the wheel shaft 54 therebetween. Each of the roller guidance grooves 56 has one end positioned on the inner side of the circumference of the pump wheel 53 and the other end positioned on the outer side of the circumference of the pump wheel 53. In other words, the roller guidance grooves 56 extend so as to gradually become further from the wheel shaft 54 as the groove progresses from one end to the other end. The pair of pressure rollers 55 are insertedly supported in the roller guidance grooves 56 via rotational shafts 57. Both rotational shafts 57 are capable of sliding freely within their respective roller guidance grooves 56.

When the pump wheel 53 rotates in the forward direction (the clockwise direction, indicated by the arrow in FIG. 4), the pressure rollers 55 in the outbound direction move to the other end of the roller guidance grooves 56 (that is, toward the outer circumferential side of the pump wheel 53), continuously pressing down the middle portion of the discharge tube 48 from the upstream side to the downstream side while rotating. Due to this rotation, the interior of the discharge tube 48 that is upstream from the tube pump 51 is depressurized.

However, when the pump wheel 53 rotates in the backward direction (that is, the counter-clockwise direction in FIG. 4), the pressure rollers 55 return in the inbound direction to the one end of the roller guidance grooves 56 (that is, toward the inner circumferential side of the pump wheel 53). Due to this movement, the pressure rollers 55 make light contact with the middle portion of the discharge tube 48, thus canceling the depressurized state of the interior of the discharge tube 48.

The raising/lowering mechanism 44 includes a cam member 58 that makes contact with the cap 43 from below, a motor 59 for rotating the cam member 58, and a driving force transmission mechanism 60. When the motor 59 is driven in the forward direction, the cam member 58 is rotated via the driving force transmission mechanism 60, and the cap 43 makes contact with the nozzle formation surface 24*a*.

Accordingly, when the pump wheel 53 is driven in the forward direction while the cap 43 is in contact with the nozzle formation surface 24*a*, negative pressure arises in a space R formed between the cap 43 and the nozzle formation surface 24*a*. Through this, suction cleaning, in which ink is discharged from the nozzles 25, is executed. The negative pressure in the space R is canceled when the pump wheel 53 is rotated in the backward direction. Thereafter, when the motor 59 of the raising/lowering mechanism 44 is driven in the backward direction, the cap 43 drops, thus removing the cap 43 from the transport path of the paper P.

Next, the wiping unit 42 will be described.

As shown in FIG. 5, the wiping unit 42 includes a wiping mechanism 61 and a raising/lowering mechanism 62 that raises/lowers the wiping mechanism 61.

The wiping mechanism 61 includes a holder 63, a lead screw 64 erected in the holder 63 so as to extend along the depth direction, a motor 65 for rotating the lead screw 64, a support member 66, and a plate-shaped wiper 67 configured of an elastic material such as rubber. The wiper 67 is supported by the support member 66 so as to be erect thereabove, and the support member 66 is supported by the lead screw 64. A holding cavity 66*a* is formed in the upper surface side of the support member 66.

The raising/lowering mechanism 62 includes a cam member 68 that makes contact with the holder 63 of the wiping mechanism 61 from below, a motor 69 for rotating the cam member 68, and a driving force transmission mechanism 70. When the motor 69 is driven in the forward direction, the cam member 68 is rotated via the driving force transmission mechanism 70, and the wiping mechanism 61 rises to a position in which the wiper 67 makes contact with the nozzle formation surface 24*a*.

When the motor 65 is driven in the forward direction and the lead screw 64 rotates in the forward direction, the wiper 67 slides along the nozzle formation surface 24*a* while moving along the depth direction with the support member 66. Wiping, in which the nozzle formation surface 24*a* is wiped clean, is executed in this manner. At this time, ink, paper dust, and so on wiped off from the nozzle formation surface 24*a* fall along the wiper 67 and are held in the holding cavity 66*a*.

Next, the pressure application mechanism 29 will be described.

Figure 6A:
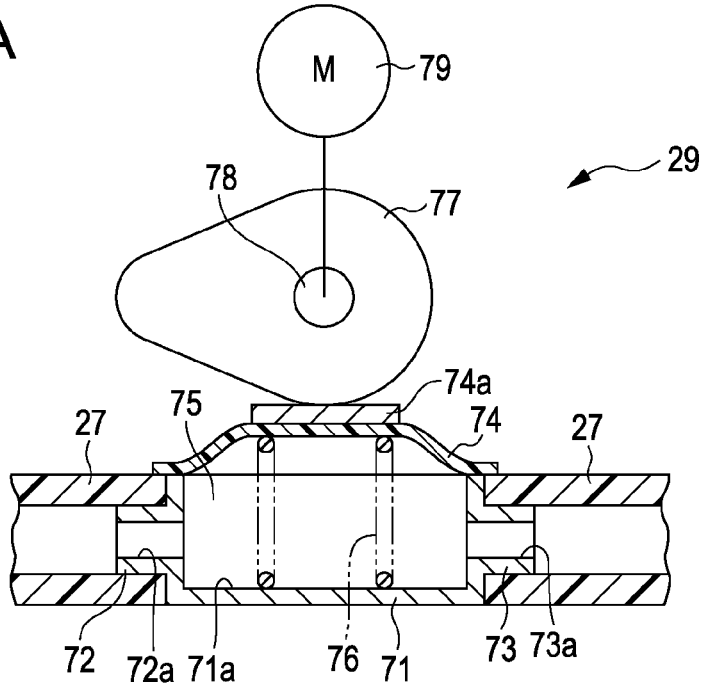
FIGS. 6A and 6B are cross-sectional views illustrating the configuration and effects of a pressure application mechanism, where
Figure 6B:
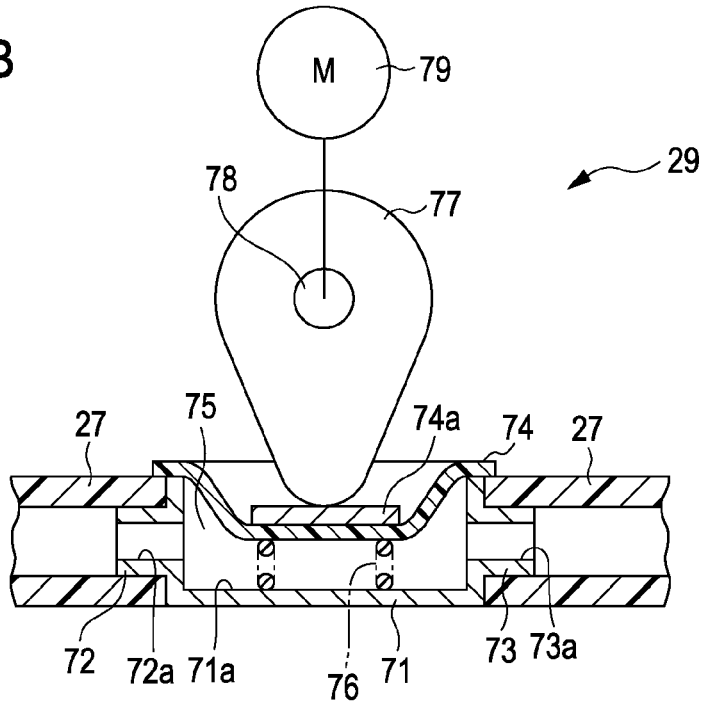

As shown in FIGS. 6A and 6B, the pressure application mechanism 29 includes a flow channel formation member 71 of a fixed shape. A connection portion 72 is provided on the left end of the flow channel formation member 71, connecting to the ink supply tube 27 on the upstream side, whereas a connection portion 73 is provided on the right side of the flow channel formation member 71, connecting to the ink supply tube 27 on the downstream side. A recessed portion 71*a*, which is circular in shape when viewed from above, is formed in the upper surface side of the flow channel formation member 71. An inflow channel 72*a* that allows the ink supply tube 27 on the upstream side to communicate with the recessed portion 71*a* is formed in the connection portion 72. Meanwhile, an outflow channel 73*a* that allows the ink supply tube 27 on the downstream side to communicate with the recessed portion 71*a* is formed in the connection portion 73.

A flexible film member 74 is affixed on the upper surface side of the flow channel formation member 71 in a flexible state so as to seal the opening of the recessed portion 71*a*. Meanwhile, a disk-shaped depression plate 74*a* whose surface area is smaller than the area of the opening of the recessed portion 71*a* is affixed approximately in the center of the outer surface side of the film member 74. A pressure chamber 75 is enclosed and formed by the film member 74 and the recessed portion 71*a*. The pressure chamber 75 configures part of the fluid supply channel by communicating with the ink supply tube 27 through the inflow channel 72*a* and the outflow channel 73*a*.

A biasing member 76 that biases the film member 74 in a direction that expands the interior volume of the pressure chamber 75 is disposed within the pressure chamber 75. The biasing member 76 can be configured from, for example, a coil spring, a plate spring, or the like. A cam member 77 that makes contact with the depression plate 74*a* is disposed above the depression plate 74*a*. The cam member 77 is supported by a rotational shaft 78, and rotates along with the rotational shaft 78 in accordance with the driving of a motor 79.

Accordingly, when the motor 79 is driven in the forward direction in the state shown in FIG. 6A, the cam member 77 rotates in the counter-clockwise direction in FIG. 6A against the biasing force of the biasing member 76. As a result, as shown in FIG. 6B, the film member 74 displaces in a direction that reduces the interior volume of the pressure chamber 75, and the ink within the ink supply tube 27 is pressurized by the ink pushed out from the pressure chamber 75. When the motor 79 is then driven in the backward direction in the state shown in FIG. 6B, the cam member 77 rotates in the clockwise direction in FIG. 6B. As a result, the film member 74 displaces in a direction that increases the interior volume of the pressure chamber 75 due to the biasing force of the biasing member 76, and the interior of the ink supply tube 27 is depressurized by the ink being sucked into the pressure chamber 75.

Next, maintenance operations in the printer 11 will be described.

In the printer 11, missing dots occur when bubbles infiltrate the ink supply tube 27 when the ink cartridge 26 is replaced, and the nozzles 25 become clogged due to ink thickening when the printer 11 is left standing with the power turned off. In order to suppress a drop in printing quality caused by such missing dots and clogs, the printer 11 executes suction cleaning, pressure cleaning, and so on using the capping unit 41. Hereinafter, cleaning in which ink is discharged from the nozzles 25 while supplying ink from the ink cartridge 26 will be referred to as "ink supply cleaning".

In the case where paper dust and so on has stuck to the nozzle formation surface 24*a* due to the printing process, the nozzle formation surface 24*a* is wiped using the wiping unit 42. Because discharged ink sticks to the nozzle formation surface 24*a*, convex meniscuses are formed in the nozzle openings 25*a*, and so on after ink supply cleaning, this wiping is carried out immediately after ink supply cleaning.

However, when such wiping is carried out, there are situations where the wiper 67 pushes air into the nozzles 25 and fine bubbles are produced in the nozzles 25. These bubbles are much smaller compared to the bubbles that infiltrate when replacing the ink cartridge 26 and so on, and thus these bubbles often accumulate in the vicinity of the nozzles 25. Accordingly, the printer 11 executes non-ink-supply cleaning using the pressure application mechanism 29 in order to discharge the fine bubbles in the vicinity of the nozzles 25.

Next, the non-ink-supply cleaning performed by the pressure application mechanism 29 will be described in detail.

Figure 7A:
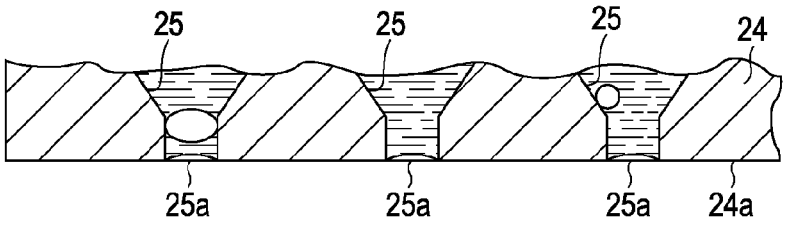
FIGS. 7A, 7B, 7C, and 7D are cross-sectional views illustrating non-ink-supply cleaning, where
Figure 7B:
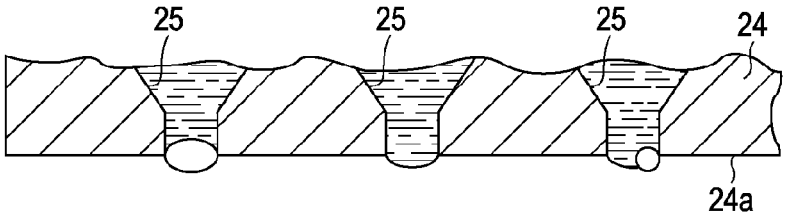

The non-ink-supply cleaning is configured of a pressurizing step, in which the pressure application mechanism 29 pressurizes the ink in the ink supply tube 27 and causes ink to swell from the nozzles 25, and a depressurizing step, carried out after the pressurizing step, in which the pressure application mechanism 29 depressurizes the interior of the ink supply tube 27 while the ink is swelling from the nozzles 25. In other words, in the pressurizing step, the pressure application mechanism 29 propagates pressure to within the nozzles 25 by expelling ink from the pressure chamber 75 all at once, thus dislodging bubbles that have stuck to the inner walls of the nozzles 25, as shown in FIG. 7A. As shown in FIG. 7B, causing the ink to swell from the nozzles 25 pushes the bubbles toward the atmosphere side, which is the outside of the nozzle openings 25*a*.

Figure 7C:
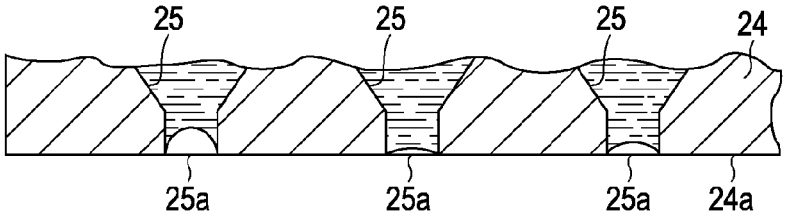
Figure 7D:
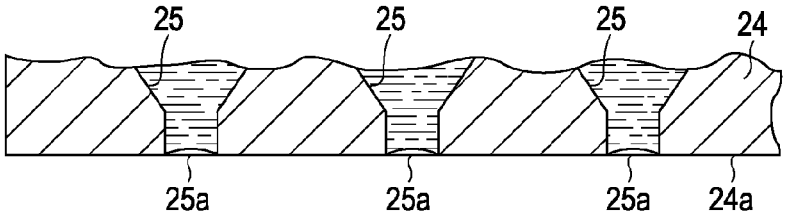

In the depressurizing step, the pressure application mechanism 29 causes the volume of the pressure chamber 75 to increase, thus pulling the volume of ink that has been pushed out back into the pressure chamber 75. Through this, the ink that has swelled out in a convex shape from the nozzles 25 is collected back into the nozzles 25, as shown in FIG. 7C, before the ink droplets Fb are ejected, fall (drip), or the like from the nozzles 25. When the bubbles are discharged, an air gap equivalent to the volume of the bubbles arises in the nozzles 25, but the ink within the common ink chamber 30 feeds into the nozzles 25 as shown in FIG. 7D due to capillarity if the printer 11 is left standing for a short amount of time.

By executing this pressurizing and depressurizing in the non-ink-supply cleaning multiple times in repetition, even bubbles that are difficult to be discharged can be gradually moved to the outside. For example, in the case where the pressurizing and depressurizing are repeated multiple times, bubbles present in the fluid ejecting head 24, the common ink chamber 30, and so on can also be discharged, in addition to the bubbles within the nozzles 25. Furthermore, even in the case where an air gap has been produced in the nozzles 25 due to the discharge of bubbles, the positions of the liquid surfaces of the nozzles 25 are gradually unified by repeating the pressurizing and the depressurizing.

In the depressurizing step, the volume that was reduced in the pressurizing step may be restored to its original volume, or the volume increased for the depressurizing may be smaller than a volume that has been reduced for the pressurizing. For example, in the case where comparatively large bubbles present within the common ink chamber 30 have been discharged by repeating the pressurizing and the depressurizing multiple times, there is also the risk of empty nozzles arising, in which the entire nozzle 25 is taken up by an air gap. When an empty nozzle has arisen in this manner, there are cases where it is difficult for the ink to fill through capillarity, and thus it is preferable to reduce the amount of ink that is sucked in, particularly during the final depressurization after pressurization and depressurization have been repeated multiple times.

Figure 8:
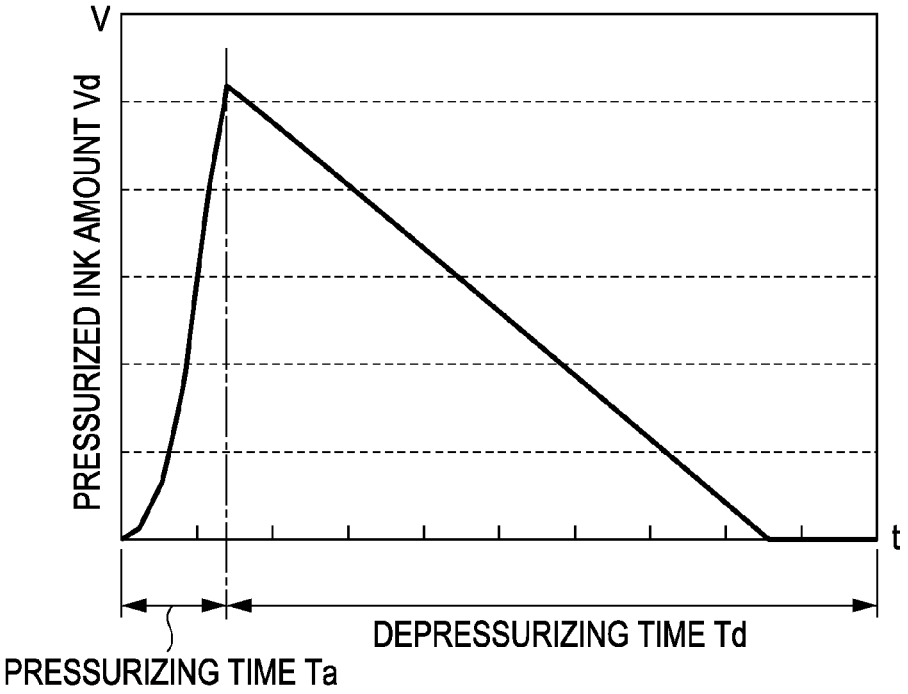
FIG. 8 is a graph illustrating a relationship between pressurizing time and depressurizing time.

Here, as shown in FIG. 8, it is preferable for a depressurizing time Td for which depressurizing is carried out during the depressurizing step to be set longer than a pressurizing time Ta for which pressurizing is carried out during the pressurizing step. If the pressurizing time Ta is too short, there is a risk of the ink droplets Fb being ejected due to the propagated pressure and ink being wastefully consumed, the depressurizing starting too early and causing the ink to be sucked back before the bubbles have been pushed out, and so on. Conversely, if the pressurizing time Ta is too long, there is a risk of the ink flow speed slowing and the bubbles not being dislodged from the inner walls of the nozzles 25, the ink not being pulled back in a timely manner by the depressurizing and the ink being consumed, and so on.

On the other hand, if the depressurizing time Td is too long, there is a risk of the ink not being pulled back in a timely manner and the ink being consumed. Conversely, if the depressurizing time Td is too short, there is a risk of air being sucked in from outside of the nozzles 25, producing bubbles.

A proper pressurizing time Ta for suppressing the ejection of ink droplets Fb and ensuring the discharge properties for bubbles is an extremely short amount of time, such as 0.05 to 0.5 seconds. On the other hand, carrying out depressurization in such a short amount of time will suck air in, and thus with a pressurizing time Ta from 0.05 to 0.5 seconds, it is preferable for the pressurizing time Ta to be less than the depressurizing time Td.

In this embodiment, the pressurization and depressurization are executed by causing the volume of the pressure chamber 75 to fluctuate to a degree at which ink droplets Fb are not ejected from the nozzles 25. Accordingly, the appropriate values for the amount of ink pushed out due to the volume fluctuation caused by the pressurization (called a "pressurized ink amount Vd" hereinafter), the pressurizing time Ta, and the depressurizing time Td fluctuate depending on flow channel conditions, such as the number of nozzles 25, fluid ejecting heads 24, and so on that are installed. A range of appropriate values for the pressurized ink amount Vd, the pressurizing time Ta, and the depressurizing time Td, as well as the flow channel conditions, will be described next.

As shown in FIG. 9, the following can be given as an example of flow channel conditions of the printer 11 according to this embodiment (called "flow channel condition 1" hereinafter): an interior volume of the ink cartridge 26 (region No. 1) of approximately 50 cc; and an interior volume of the ink supply tube 27 from the ink cartridge 26 to the pressure chamber 75 (region No. 2) of approximately 3.5 cc. Furthermore, the volume of the pressure chamber 75 capable of fluctuating (region No. 3) is approximately 1.0 cc; the interior volume of the ink supply tube 27 downstream from the pressure chamber 75 (region No. 4) is approximately 1.9 cc; the interior volume of the common ink chamber 30 (region No. 5) is approximately 3.1 cc; and the total interior volume of the eight fluid ejecting heads 24 (region No. 6) is approximately 0.9 cc.

An appropriate range of the pressurized ink amount Vd when carrying out non-ink-supply cleaning under the flow channel condition 1 is illustrated in FIG. 10A, whereas appropriate ranges for the pressurizing time Ta and the depressurizing time Td are illustrated in FIG. 10B.

With respect to the pressurized ink amount Vd, it is preferable to carry out pressurization so that the approximately 1.0 cc volume of the pressure chamber 75 is reduced to a volume in the range of 0.22 cc≤Vd≤0.62 cc. If 0.22 cc>Vd, there is a risk that sufficient pressurizing for discharging the bubbles cannot be obtained, whereas if 0.62 cc<Vd, there is a risk of consuming ink.

In the case where 0.22 cc≤Vd≤0.62 cc, it is preferable for the pressurizing time Ta to be 0.05 seconds≤Ta≤0.5 seconds and for the depressurizing time Td to be 0.09 seconds≤Td≤0.7 seconds (assuming, however, that Ta<Td).

With the non-ink-supply cleaning performed by the pressure application mechanism 29, the risk of ink sticking to the nozzle formation surface 24*a* after the cleaning is executed is low, and the meniscuses of the nozzles 25 can be unified, which makes it unnecessary to carry out wiping as post-processing, as is the case with ink supply cleaning. Ink consumption can be reduced to nearly zero, and the cleaning can be carried out in an extremely short amount of time.

According to the embodiment described thus far, the following effects can be obtained.

(1) Some ink is caused to swell from the nozzles 25 by the pressure application mechanism 29 pressurizing the ink within the ink supply tube 27, making it possible to push bubbles that have intermixed with the ink at the swollen area out to the atmospheric side, which is outside of the nozzle openings 25*a*. The pressure application mechanism 29 depressurizes the interior of the ink supply tube 27 immediately after the pressurization, which then pulls the ink that has swollen from the nozzles 25 due to the pressurization back into the fluid ejecting heads 24, so that the ink is not wasteful consumed by falling from the nozzle openings 25*a* or the like. Thus according to the non-ink-supply cleaning performed by the pressure application mechanism 29, bubbles can be discharged while also suppressing the consumption of ink.

(2) By pressurizing for a short amount of time so as to ensure the bubble discharge properties while also making the depressurizing time Td longer than the pressurizing time Ta, it is possible to suppress bubbles from being sucked in through the nozzle openings 25*a*.

(3) By the pressure application mechanism 29 reducing the volume of the pressure chamber 75, an amount of ink equivalent to the reduced volume is pushed out, thus making it possible to transmit the pressure toward the nozzles 25. Because depressurization is carried out by increasing the volume of the pressure chamber 75, the depressurization can be carried out immediately after the pressurization by returning the volume, which has been reduced for pressurization, to its original state.

(4) When bubbles are discharged from the nozzles 25 through pressurization, an equivalent air gap is produced within the nozzles 25; however, by reducing the volume of the pressure chamber 75 increased for depressurization beyond the volume of the pressure chamber 75 reduced for pressurization, the occurrence of empty nozzles caused by the air gaps can be suppressed.

(5) The meniscuses of the nozzles 25 can be unified by adjusting the backpressure of the nozzles 25 in the common ink chamber 30. For example, the flow of ink caused by pressurization and depressurization in the non-ink-supply cleaning is transmitted to the nozzles 25 through the common ink chamber 30. Accordingly, even in the case where an air gap has been produced within a single nozzle 25 from which bubbles have been discharged, repeating the pressurization and depressurization unifies the position of the liquid surface with the other nozzles 25. The pressure application mechanism 29 is provided upstream from the common ink chamber 30 in the ink flow channel, and thus increasing the number of fluid ejecting heads 24 does not complicate the configuration.

(6) The pressurizing time Ta for which the pressure application mechanism 29 carries out pressurization is, under the flow channel condition 1, between 0.05 and 0.5 seconds, and is thus extremely short; accordingly, it is possible to dislodge bubbles that have adhered to the inner walls of the nozzles 25 and discharge those bubbles.

Second Embodiment

Next, a second embodiment of the invention will be described based on FIGS. 11 to 13.

With the printer 11 according to the first embodiment, the regions No. 1 through No. 6 of which the ink flow channel is configured communicate with each other, and thus ink that has been pushed out of the pressure chamber 75 moves not only into the regions No. 3 through No. 6 that are downstream, but also into the regions No. 1 and No. 2 that are upstream. For this reason, the pressure extending to the nozzles 25 weakens by the amount by which the pressure is transmitted upstream. Accordingly, in the second embodiment, a printer 11A capable of causing the ink that has been pushed out to flow downstream only will be described.

Figure 11:
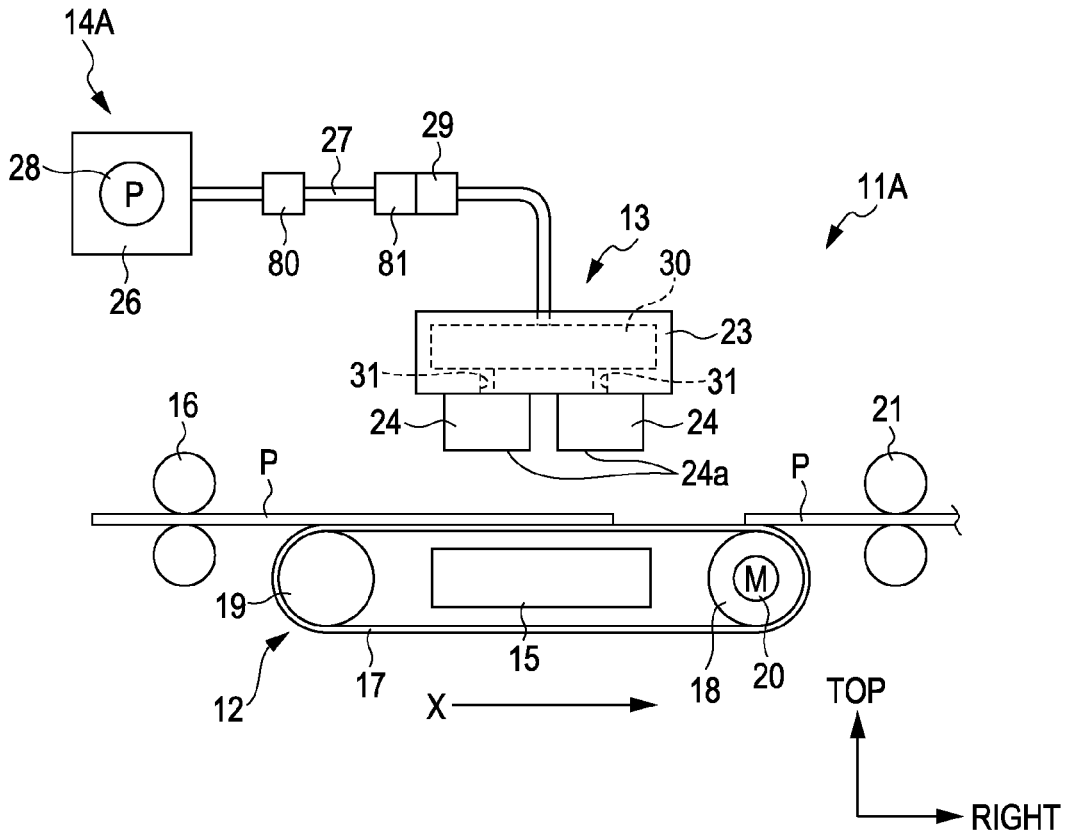
FIG. 11 is a schematic front view illustrating the overall configuration of an ink jet printer according to a second embodiment.

As shown in FIG. 11, the printer 11A according to the second embodiment includes an ink supply unit 14A in place of the ink supply unit 14 of the printer 11. In the ink supply unit 14A, a differential pressure regulating valve 80 and an on-off valve 81 are provided in the ink supply tube 27.

The on-off valve 81 is a valve that can be opened or closed as desired, and is provided immediately upstream from the pressure application mechanism 29. A solenoid valve, a valve that operates mechanically, or the like can be employed as the on-off valve 81. When executing non-ink-supply cleaning, putting the differential pressure regulating valve 80 into a closed state causes the ink that has been pushed out from the pressure chamber 75 to flow downstream only.

The differential pressure regulating valve 80 is a diaphragm-type self-sealing valve that opens and closes using a differential pressure between the atmospheric pressure and the ink pressure, and is disposed between the ink cartridge 26 and the on-off valve 81. In the printer 11A, the ink cartridge 26 (the cartridge holder, which is not shown) is provided in a higher position than the line head 13. Accordingly, the interior of the fluid ejecting head 24 has a negative pressure of approximately −1 kPa due to the differential pressure regulating valve 80.

Figure 12A:
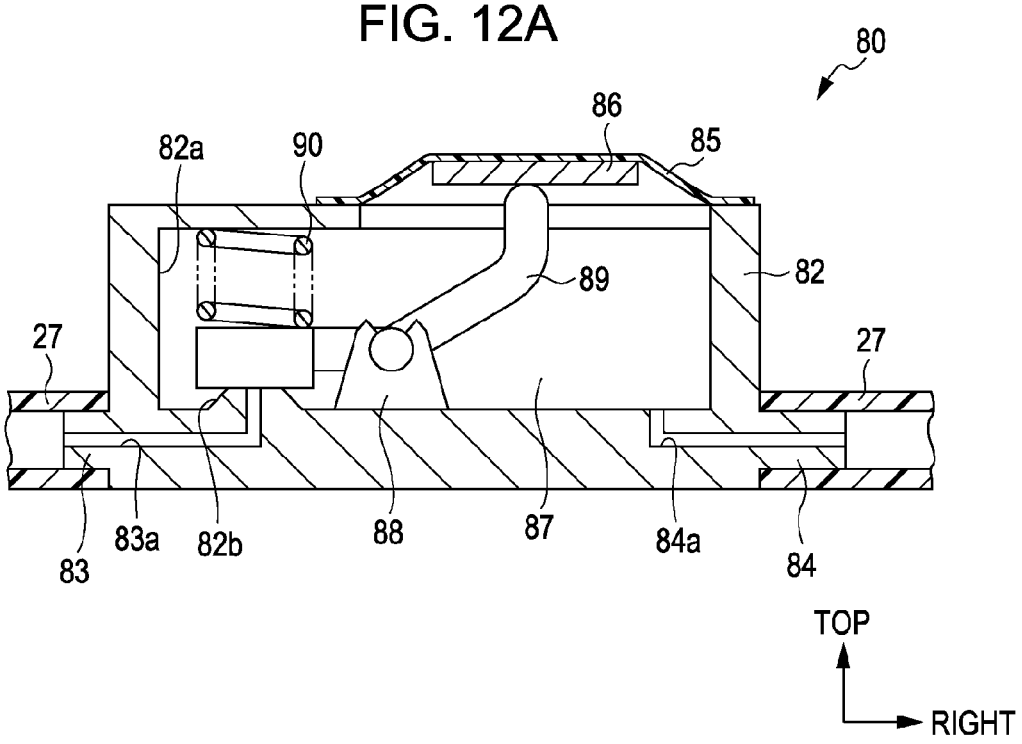
FIGS. 12A and 12B are cross-sectional views illustrating the configuration and effects of a differential pressure regulating valve, where

As shown in FIG. 12A, the differential pressure regulating valve 80 includes a flow channel formation member 82 of a fixed shape. A connection portion 83 is provided on the left end of the flow channel formation member 82, connecting to the ink supply tube 27 on the upstream side, whereas a connection portion 84 is provided on the right side of the flow channel formation member 82, connecting to the ink supply tube 27 on the downstream side. A recessed portion 82*a*, which is circular in shape when viewed from above, is formed in the upper surface side of the flow channel formation member 82, and a single protruding portion 82*b* having a conical trapezoidal shape is formed in a location of the inner base surface of the recessed portion 82*a* that is shifted to the left of the center. An inflow channel 83*a* that allows the ink supply tube 27 on the upstream side to communicate with the recessed portion 82*a* is formed in the connection portion 83, so that an opening into the recessed portion 82*a* is formed in the upper end surface of the protruding portion 82*b*. Meanwhile, an outflow channel 84*a* that allows the ink supply tube 27 on the downstream side to communicate with the recessed portion 82*a* is formed in the connection portion 84.

A flexible film member 85 is affixed on the upper surface side of the flow channel formation member 82 in a flexible state so as to seal the opening of the recessed portion 82*a*. Meanwhile, a disk-shaped depression plate 86 whose surface area is smaller than the area of the opening of the recessed portion 82*a* is affixed approximately in the center of the inner surface side of the film member 85 that faces toward the recessed portion 82*a*. A pressure chamber 87 is enclosed and formed by the film member 85 and the recessed portion 82*a*.

A base section 88, an arm member 89 supported by the base section 88 in a tillable state, and a biasing spring 90 that biases one end of the arm member 89 (the left end) toward the protruding portion 82*b* are housed within the pressure chamber 87. Under the constant biasing force of the biasing spring 90, the one end of the arm member 89 seals the opening of the inflow channel 83*a* provided in the upper end surface of the protruding portion 82*b*, while the other end (the right end) pushes the depression plate 86 in the upward direction. Accordingly, the film member 85 is flexed in a direction that expands the interior volume of the pressure chamber 87, and thus the pressure chamber 87 and the interior of the fluid ejecting head 24 positioned in an area downstream therefrom have a negative pressure of approximately −1 kPa.

Figure 12B:
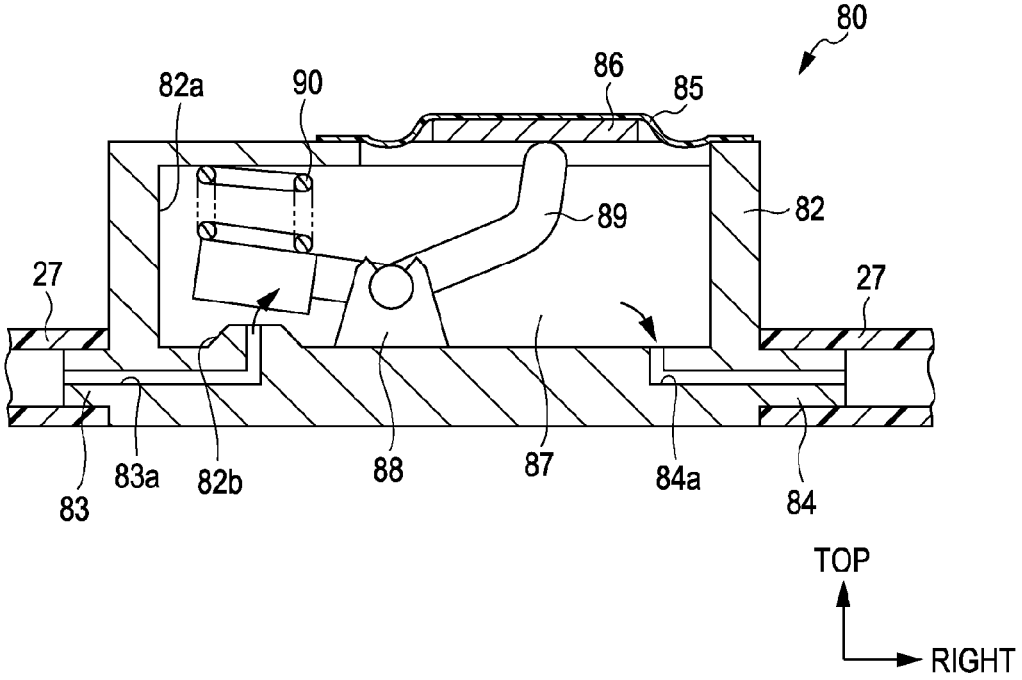

Ink is supplied to the inflow channel 83*a* in a pressurized state by the pressure pump 28, and the inflow of ink into the pressure chamber 87 is suppressed by the one end of the arm member 89, which constantly receives the biasing force from the biasing spring 90. The negative pressure within the pressure chamber 87 increases as ink is consumed by ejection from the nozzles 25 or outflow, and as shown in FIG. 12B, the film member 85 flexes, against the biasing force of the biasing spring 90, in a direction that reduces the interior volume of the pressure chamber 87. Upon doing so, the other end of the arm member 89 tilts so as to press upon the film member 85 through the depression plate 86 and the one end opens the opening of the inflow channel 83*a*, and as a result, the ink pressurized within the pressure chamber 87 flows in through the inflow channel 83*a*.

As the negative pressure within the pressure chamber 87 decreases due to the inflow of ink, the arm member 89 and the film member 85 return to their original positions due to the biasing force of the biasing spring 90. Accordingly, an amount of ink in accordance with the amount that has been consumed is supplied to the fluid ejecting head 24.

Next, non-ink-supply cleaning according to this embodiment will be described.

This non-ink-supply cleaning is configured of a valve closing step in which the on-off valve 81 is closed, a pressurizing step of causing ink to swell from the nozzles 25 by the pressure application mechanism 29 carrying out pressurization after the valve closing step, and a depressurizing step of the pressure application mechanism 29 carrying out depressurization in a state in which the ink has swelled from the nozzles 25 as a result of the pressurization.

By carrying out the pressurizing step and the depressurizing step while the on-off valve 81 is closed in this manner, ink is not supplied from upstream from the on-off valve 81 and is thus not ejected and does not drip down from the nozzle openings 25*a*; accordingly, ink is not consumed during the non-ink-supply cleaning.

In the printer 11A, it is assumed that the differential pressure regulating valve 80 is in a closed state when the non-ink-supply cleaning is executed (this state will be referred to as a "flow channel condition 2" hereinafter). Under the flow channel condition 2, of the regions illustrated in FIG. 9, the regions aside from the regions No. 1 and 2, or the regions No. 3 through 6, correspond to the range that is affected by the pressurization and depressurization.

An appropriate range of the pressurized ink amount Vd when carrying out non-ink-supply cleaning under the flow channel condition 2 is illustrated in FIG. 13A, whereas appropriate ranges for the pressurizing time Ta and the depressurizing time Td are illustrated in FIG. 13B.

With respect to the pressurized ink amount Vd, it is preferable to carry out pressurization so that the approximately 1.0 cc volume of the pressure chamber 75 is reduced to a volume in the range of 0.18 cc≤Vd≤0.48 cc. In other words, because a loss in the pressure arising when ink flows toward the regions No. 1 and 2 is eliminated, bubbles can be discharged with a lower pressurized ink amount Vd under the flow channel condition 2 than under the flow channel condition 1. In this case, because 5,280 nozzles 25 are provided in a single line head 13, a favorable ink swell range for a single nozzle is approximately $3.5\times10^{-5}$ cc to $9.0\times10^{-5}$ cc. It has been confirmed that particularly favorable results can be obtained by pressurizing at Ta=0.15 seconds and depressurizing at Td=0.35 seconds with Vd=0.33 cc.

In the case where 0.18 cc≤Vd≤0.48 cc, it is preferable for the pressurizing time Ta to be 0.025 seconds≤Ta≤0.2 seconds and for the depressurizing time Td to be 0.1 seconds≤Td≤0.5 seconds (assuming, however, that Ta<Td). In other words, considering the flow channel conditions 1 and 2, it is preferable to set the pressurizing time Ta at which the pressure application mechanism 29 carries out pressurization in the pressurizing step to 0.025 seconds to 0.5 seconds.

According to the embodiment described thus far, the following effects can be obtained in addition to effects similar to those in the aforementioned (1) to (5).

(6) Some ink is caused to swell from the nozzles 25 by the pressure application mechanism 29 pressurizing the ink within the ink supply tube 27, making it possible to push bubbles that have intermixed with the ink at the swollen area out to the atmospheric side, which is outside of the nozzle openings 25*a*. Because the on-off valve 81 is closed at this time, ink is not supplied to nozzles from the ink supply tube 27 that is upstream from the on-off valve 81. Accordingly, bubbles can be discharged from the nozzles 25 while suppressing the consumption of ink.

(7) Because the pressure application mechanism 29 depressurizes the interior of the ink supply tube 27 after pressurization while maintaining the closed state of the on-off valve 81, ink that is swelling from the nozzles 25 can be pulled back into the fluid ejecting head 24 without being consumed wastefully due to dripping down from the nozzle openings 25*a* and so on. Accordingly, the meniscuses of the nozzles 25 can be suppressed from breaking, and the consumption of ink can be suppressed as well. The pressure can be increased by the amount of ink that is pulled back due to the depressurization, thus making it possible to improve the bubble discharge properties.

(8) Multiple pressure application mechanisms 29 are provided in accordance with the number of ink supply tubes 27 that are installed, thus making it possible to discharge bubbles for each of the ink supply tubes 27.

(9) The pressurizing time Ta for which the pressure application mechanism 29 carries out pressurization is between 0.025 and 0.2 seconds, and is thus extremely short; accordingly, it is possible to dislodge bubbles that have adhered to the inner walls of the nozzles 25 and discharge those bubbles.

The aforementioned embodiments may be changed to the embodiments described hereinafter as well.

Figure 14:
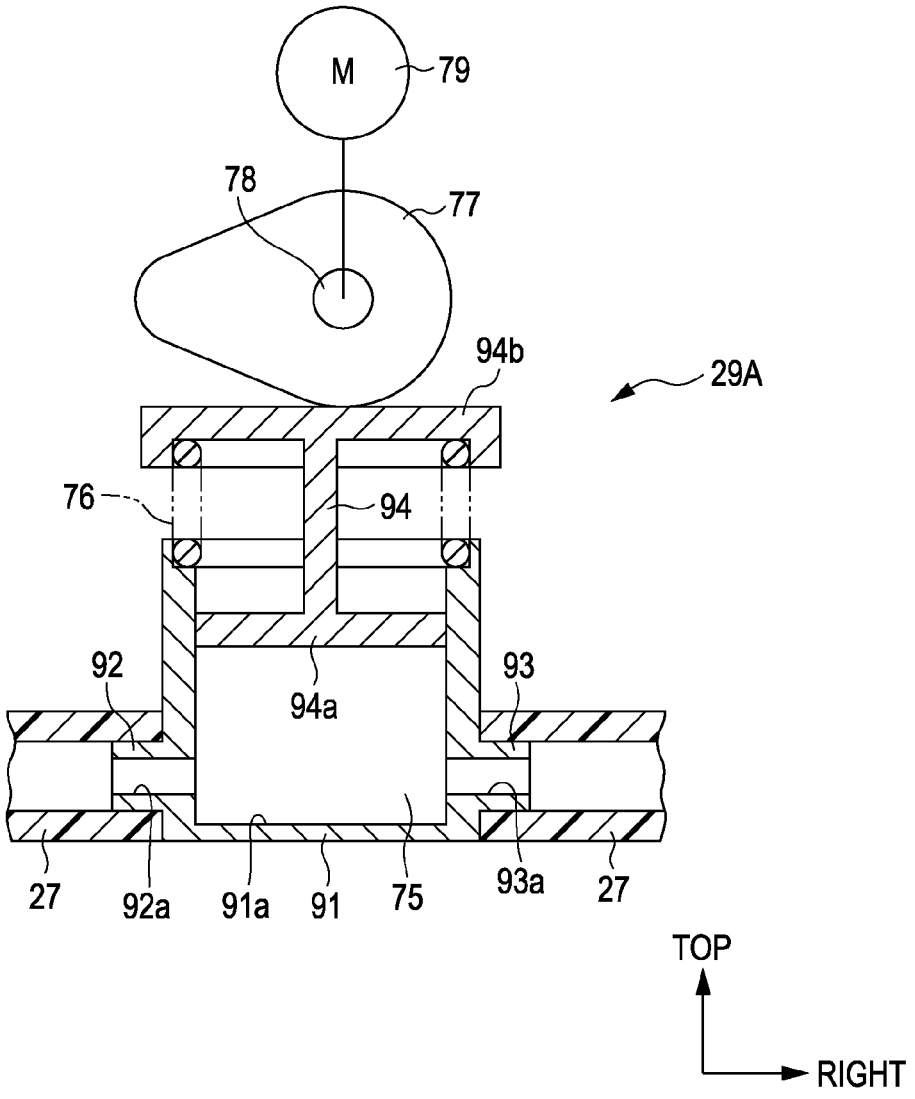
FIG. 14 is a cross-sectional view illustrating a variation on the configuration of a pressure application mechanism.

The pressure application mechanism 29 may have the configuration of a pressure application mechanism 29A, as illustrated in FIG. 14.

The pressure application mechanism 29A includes a flow channel formation member 91 of a fixed shape. A connection portion 92 is provided on the left end of the flow channel formation member 91, connecting to the ink supply tube 27, whereas a connection portion 93 is provided on the right side of the flow channel formation member 91, connecting to the ink supply tube 27. A recessed portion 91*a*, which is circular in shape when viewed from above, is formed in the upper surface side of the flow channel formation member 91. An inflow channel 92*a* that allows the ink supply tube 27 to communicate with the recessed portion 91*a* is formed in the connection portion 92. Meanwhile, an outflow channel 93*a* that allows the ink supply tube 27 to communicate with the recessed portion 91*a* is formed in the connection portion 93.

A piston 94 is housed in the recessed portion 91*a* of the flow channel formation member 91 so as to be capable of sliding. One end (the lower end) of the piston 94 configures a disk-shaped mobile portion 94*a* that in turn configures one wall surface of the pressure chamber 75, whereas the other end (the upper end) of the piston 94 configures a disk-shaped pressure receiving portion 94*b*. The pressure chamber 75 is enclosed and formed by the mobile portion 94*a* of the piston 94 and the recessed portion 91*a* of the flow channel formation member 91.

The biasing member 76, composed of a spring, is disposed between the upper surface side of the flow channel formation member 91 and the lower surface side of the pressure receiving portion 94*b*. Accordingly, when the motor 79 is driven in the forward direction and the cam member 77 rotates in the counter-clockwise direction in FIG. 14, the mobile portion 94*a* of the piston 94 moves in a direction away from the rotational shaft 78. Upon doing so, the volume of the pressure chamber 75 decreases, and the ink within the ink supply tube 27 is pressurized by the ink that has been pushed out from the pressure chamber 75. When the motor 79 is driven in the backward direction and the cam member 77 rotates in the clockwise direction in FIG. 14, the mobile portion 94*a* of the piston 94 moves in a direction toward the rotational shaft 78 due to the biasing force of the biasing member 76. Upon doing so, the volume of the pressure chamber 75 increases, and the inner of the ink supply tube 27 is depressurized by the ink that has been pulled into the pressure chamber 75.

With respect to the pressure application mechanism 29, the piston 94 of the pressure application mechanism 29A may be configured of a movable core, and a solenoid may be provided in the periphery thereof. In this case, the piston 94 configured of the movable core can be moved by flowing a current to the solenoid and generating a magnetic field.

The pressure application mechanism may include a piezoelectric element, and the pressurization and depressurization may be carried out by changing the volume of the fluid supply channel using the piezoelectric element.

The ink supply tube 27 capable of elastic deformation may be pressurized by the cam member 77 pressing down thereupon. In this case, the flow channel formation member 71 need not be provided, which makes it possible to simplify the configuration.

For example, rather than including the common ink chamber 30, one end of the ink supply tube 27 (a base end) may be connected to the ink cartridge 26, and the other end (a leading end) of the ink supply tube 27 may be connected to the fluid ejecting head 24 via multiple branches. In this case, the pressure application mechanism 29 may be provided on the base end, or the pressure application mechanism 29 may be provided on the branched leading end.

The pressure application mechanism may be provided between the common ink chamber 30 and the reservoir 36, or may be provided between the reservoir 36 and the cavity 39.

The liquid flow channel may be configured of rigid tubing that does not easily experience elastic deformation. In this case, pressure fluctuations caused by the pressurization in the pressurizing step and the depressurization in the depressurizing step can be transmitted to the nozzles 25 without being absorbed by the elastic deformation of the tubing.

In the case where the flow channel conditions, the fluid that is ejected, or the like has been changed, the friction resistance, flow channel resistance, viscosity, and so on change, and it is thus preferable to adjust the pressurized ink amount Vd, the pressurizing time Ta, and the depressurizing time Td to values appropriate thereto.

The number of fluid ejecting heads 24, nozzles 25, nozzle rows N, and so on can be set as desired.

A non-removable ink tank may be employed for a fluid holding unit.

The invention may be realized using a full-line type line head printer having a long fluid ejecting head, a lateral printer, or a serial printer.

Although the fluid ejecting apparatus is embodied as an ink jet printer in the aforementioned embodiment, a fluid ejecting apparatus that ejects or discharges a fluid aside from ink may be employed as well, and the invention can be applied to various types of liquid ejecting apparatuses that include liquid ejecting heads or the like that discharge miniature-sized liquid droplets. "Droplet" refers to the state of the liquid ejected from the liquid ejecting apparatus, and is intended to include granule forms, teardrop forms, and forms that pull tails in a string-like form therebehind. The "liquid" referred to here can be any material capable of being ejected by the liquid ejecting apparatus. For example, any matter can be used as long as the matter is in its liquid state, including liquids having high or low viscosity, sol, gel water, other inorganic agents, organic agents, liquid solutions, liquid resins, and fluid states such as liquid metals (metallic melts); furthermore, in addition to liquids as a single state of a matter, liquids in which the molecules of a functional material composed of a solid matter such as pigments, metal particles, or the like are dissolved, dispersed, or mixed in a liquid carrier are included as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. The following are specific examples of liquid ejecting apparatuses: liquid ejecting apparatuses that eject liquids including materials such as electrode materials, coloring materials, and so on in a dispersed or dissolved state for use in the manufacture and so on of, for example, liquid-crystal displays, EL (electroluminescence) displays, front emission displays, and color filters; liquid ejecting apparatuses that eject bioorganic matters used in the manufacture of biochips; liquid ejecting apparatuses that eject liquids to be used as samples for precision pipettes; printing equipment and microdispensers; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatus that eject an etching liquid such as an acid or alkali onto a substrate or the like for etching. The invention can be applied to any type of these ejecting apparatuses.

What is claimed is:

1. A fluid ejecting apparatus comprising:

a fluid ejecting head provided with multiple nozzles that eject a fluid;

a fluid supply channel that supplies the fluid to the fluid ejecting head;

an on-off valve provided in the fluid supply channel;

a differential pressure regulating valve located in the fluid supply channel and upstream from the on-off valve; and a pressure application mechanism that pressurizes the fluid within the fluid supply channel downstream from the on-off valve when the on-off valve is closed, wherein the pressure application mechanism is provided in the fluid supply channel and located downstream of the on-off valve.

2. The fluid ejecting apparatus according to claim 1, wherein the pressure application mechanism depressurizes the interior of the fluid supply channel downstream from the on-off valve in a state in which the on-off valve is closed and the fluid is swelling from the nozzles due to the pressurization.

3. The fluid ejecting apparatus according to claim 1, wherein multiple fluid supply channels are provided and the same number of pressure application mechanisms as the fluid supply channels is provided.

4. The fluid ejecting apparatus according to claim 1, wherein the pressure application mechanism pressurizes the fluid to swell the fluid from the nozzles.

5. The fluid ejecting apparatus according to claim 1, wherein the pressure application mechanism has a pressure chamber, a biasing member that is disposed within the pressure chamber to depressurize the interior of the fluid supply channel by biasing in a direction that expands an interior volume of the pressure chamber and a cam member that to pressurize the fluid within the fluid supply channel by displacing in a direction that reduces the interior volume of the pressure chamber.

* * * * *